US010547105B2

(12) United States Patent
Logan et al.

(10) Patent No.: US 10,547,105 B2
(45) Date of Patent: Jan. 28, 2020

(54) SUPERSTRATE POLARIZATION AND IMPEDANCE RECTIFYING ELEMENTS

(71) Applicant: The Government of the United States of America, as represented by the Secretary of the Navy, Arlington, VA (US)

(72) Inventors: John T. Logan, Alexandria, VA (US); Rick W. Kindt, Arlington, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 36 days.

(21) Appl. No.: 15/910,714

(22) Filed: Mar. 2, 2018

(65) Prior Publication Data

US 2018/0254553 A1 Sep. 6, 2018

Related U.S. Application Data

(60) Provisional application No. 62/466,029, filed on Mar. 2, 2017.

(51) Int. Cl.
*H01Q 21/06* (2006.01)
*H01Q 1/52* (2006.01)
(Continued)

(52) U.S. Cl.
CPC ..... *H01Q 1/523* (2013.01); *H01Q 21/0025* (2013.01); *H01Q 21/062* (2013.01); *H01Q 21/064* (2013.01); *H01Q 25/001* (2013.01)

(58) Field of Classification Search
CPC ..... H01Q 1/523; H01Q 1/40; H01Q 25/001; H01Q 21/062; H01Q 21/064;
(Continued)

(56) References Cited

U.S. PATENT DOCUMENTS 5,175,560 A 12/1992 Lucas et al.
5,642,121 A 6/1997 Martek et al.
(Continued)

FOREIGN PATENT DOCUMENTS

CN 203826551 9/2014
WO WO-2016138267 A1 9/2016
WO WO-2016141177 A1 9/2016

OTHER PUBLICATIONS

International Search Report and Written Opinion for PCT/US2018/020681 from the International Searching Authority, dated Mar. 2, 2018.

(Continued)

*Primary Examiner* — Daniel Munoz
*Assistant Examiner* — Awat M Salih
(74) *Attorney, Agent, or Firm* — US Naval Research Laboratory; William P. Ladd

(57) ABSTRACT

Systems and methods are provided for enhancing the electrical performance of ultra-wideband (UWB) electronically scanned arrays (ESA) for use in multifunctional, electronic warfare, communications, radar, and sensing systems. Embodiments of the present disclosure provide designed metal and dielectric elements placed above the arbitrary radiator (i.e., in the superstrate region) to simultaneously aid impedance and polarization challenges. These elements can be compatible with arbitrary antenna element types.

18 Claims, 15 Drawing Sheets

(51) Int. Cl.
*H01Q 21/00* (2006.01)
*H01Q 25/00* (2006.01)

(58) Field of Classification Search
CPC .. H01Q 21/0025; H01Q 21/067; H01Q 15/12; H01Q 15/04; H01Q 19/09
See application file for complete search history.

(56) References Cited

U.S. PATENT DOCUMENTS

| | | | | |
|---|---|---|---|---|
| 6,246,399 | B1 | 6/2001 | Aiello et al. | |
| 6,317,094 | B1 | 11/2001 | Wu et al. | |
| 7,652,631 | B2 | 1/2010 | McGrath | |
| 8,253,641 | B1 | 8/2012 | Waterman | |
| 8,350,759 | B2 * | 1/2013 | Ju ..... | H01Q 15/0086 343/700 MS |
| 2001/0048395 | A1 | 12/2001 | Apostolos | |
| 2004/0080465 | A1 | 4/2004 | Hendler et al. | |
| 2005/0007286 | A1 | 1/2005 | Trott et al. | |
| 2005/0200531 | A1 | 9/2005 | Huang et al. | |
| 2005/0219126 | A1 | 10/2005 | Rebeiz et al. | |
| 2006/0061513 | A1 | 3/2006 | Sato | |
| 2008/0246680 | A1 | 10/2008 | Rawnick et al. | |
| 2010/0176997 | A1 | 7/2010 | Ikegaya et al. | |
| 2010/0277374 | A1 | 11/2010 | Ju et al. | |
| 2011/0128202 | A1 * | 6/2011 | Ju ..... | H01Q 1/38 343/767 |
| 2012/0001826 | A1 | 1/2012 | Achour et al. | |
| 2012/0146869 | A1 | 6/2012 | Holland et al. | |
| 2012/0229361 | A1 | 9/2012 | Goins et al. | |
| 2012/0299785 | A1 | 11/2012 | Bevelacqua | |
| 2013/0241787 | A1 | 9/2013 | Coburn et al. | |
| 2014/0138546 | A1 | 5/2014 | Iluz et al. | |
| 2014/0218251 | A1 | 8/2014 | Waschenko et al. | |
| 2015/0084814 | A1 | 3/2015 | Rojanski et al. | |
| 2015/0295309 | A1 | 10/2015 | Manry, Jr. et al. | |
| 2018/0069322 | A1 | 3/2018 | Vouvakis et al. | |

OTHER PUBLICATIONS

Extended European Search report for European Application No. 16759488.6 from the European Patent Office, dated Sep. 27, 2018.
International Search Report and Written Opinion for PCT/US2016/020669 from the International Searching Authority, dated May 17, 2016.

* cited by examiner

SUPERSTRATE POLARIZATION AND IMPEDANCE RECTIFYING ELEMENTS

CROSS REFERENCE TO RELATED APPLICATIONS

This application claims the benefit of U.S. Provisional Patent Application No. 62/466,029, filed on Mar. 2, 2017, which is incorporated by reference herein in its entirety.

FIELD OF THE DISCLOSURE

This disclosure relates to antennas, including electronically scanned array antennas.

BACKGROUND

Electronically scanned arrays (ESAs) with ultra-wideband (UWB) and wide-scan radiation performance are desirable for applications such as multi-functional systems, high-throughput or low-power communications, high-resolution and clutter resilient radar/sensing, and electromagnetic warfare systems. All types of ESA antennas currently employed suffer well-known impedance and polarization challenges when scanning (e.g., flared notches, dipoles, slots, loops, etc.) Impedance problems can involve poor matching, reflections, reduced effective isotropic radiated power (EIRP), poor noise figures, etc. Polarization problems can degrade target discrimination, sensing, communications, links, etc.

BRIEF DESCRIPTION OF THE DRAWINGS/FIGURES

The accompanying drawings, which are incorporated in and constitute part of the specification, illustrate embodiments of the disclosure and, together with the general description given above and the detailed descriptions of embodiments given below, serve to explain the principles of the present disclosure. In the drawings.

Figure 6A:
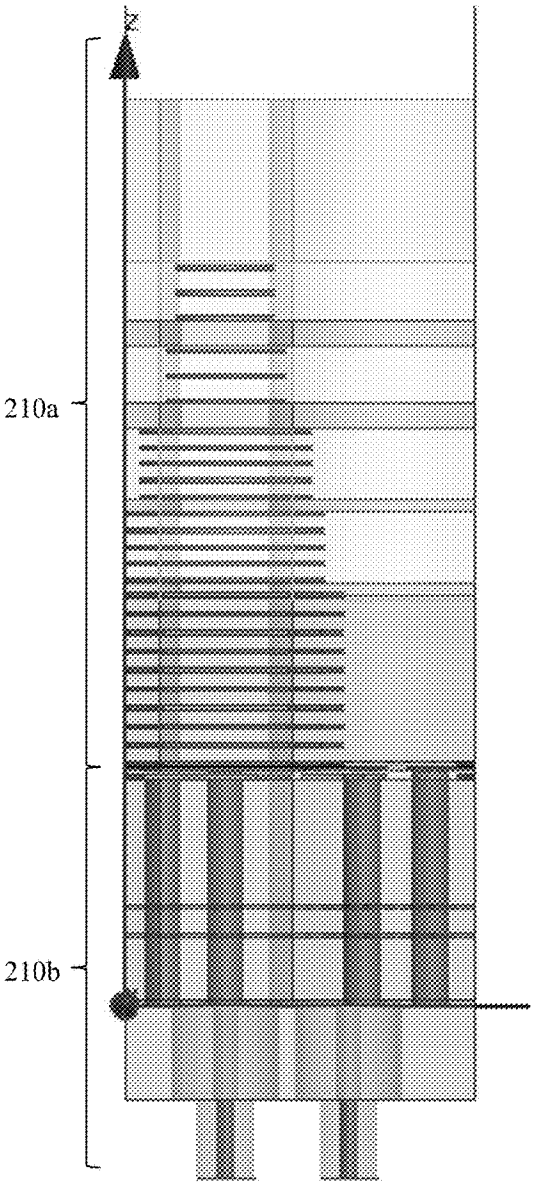
FIG. 6A is a two-dimensional diagram of a SPIRE component and an antenna base without conductive posts (i.e., with flat conductive panels) in accordance with an embodiment of the present disclosure.
Figure 6B:
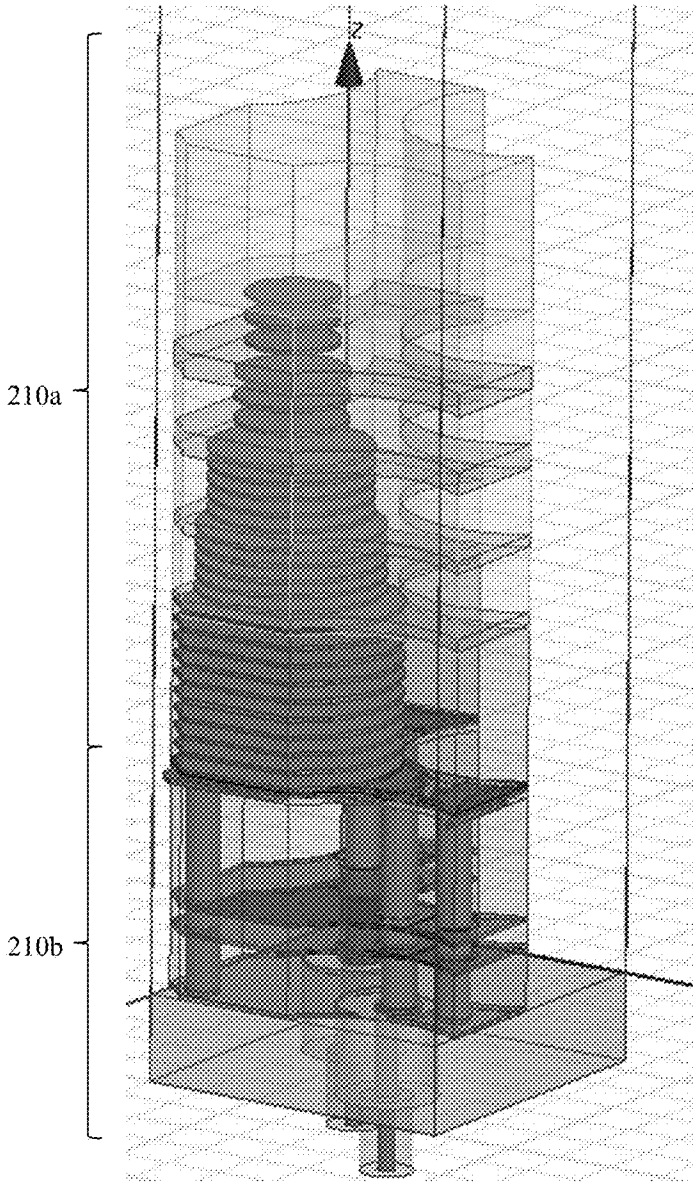
Figure 7:
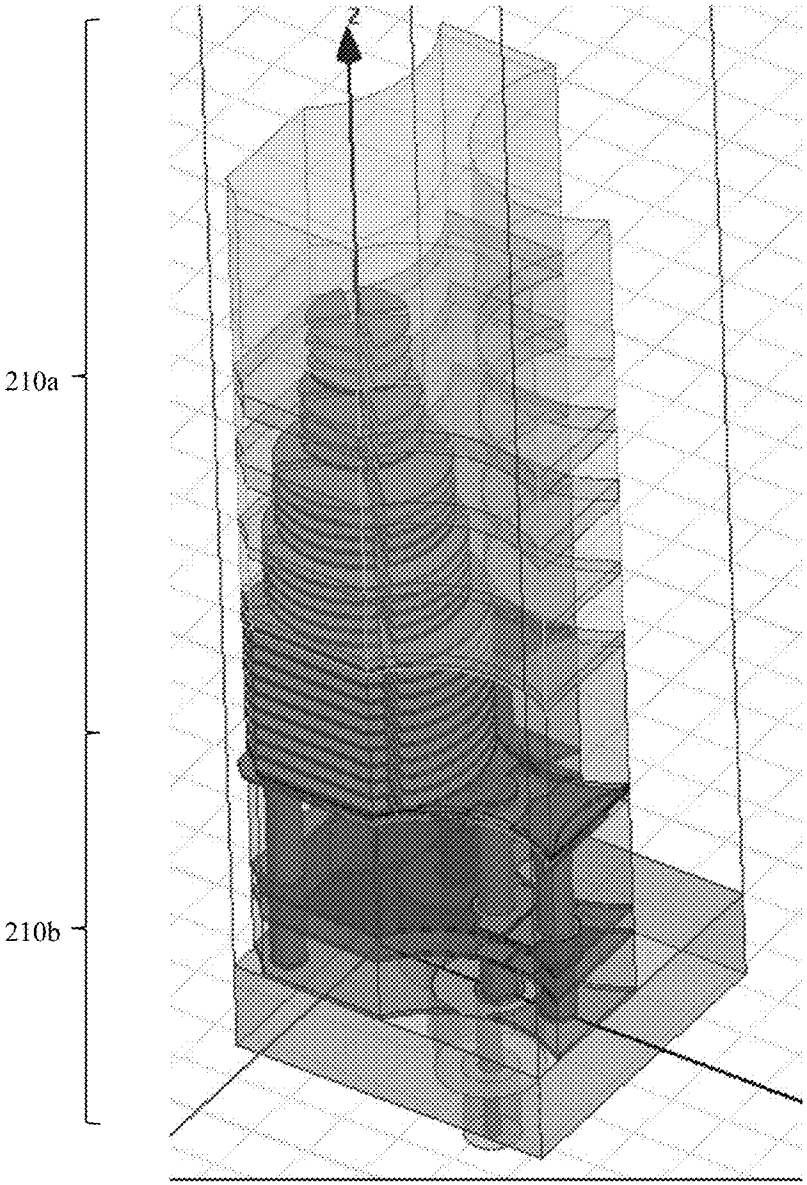

FIG. 6B is a three-dimensional diagram of a SPIRE component and an antenna base without conductive posts (i.e., with flat conductive panels) in accordance with an embodiment of the present disclosure; and FIG. 7 is a three-dimensional diagram of a SPIRE component and an antenna base without conductive posts, wherein the flat conductive panels are divided into four segments in accordance with an embodiment of the present disclosure.

Features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

In the following description, numerous specific details are set forth to provide a thorough understanding of the disclosure. However, it will be apparent to those skilled in the art that the disclosure, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

1. Overview

Embodiments of the present disclosure provide systems and methods for enhancing the electrical performance of ultra-wideband (UWB) electronically scanned arrays (ESA). ESAs in accordance with embodiments of the present disclosure can be used, for example, in multifunctional, electronic warfare, communications, radar, and sensing systems. Embodiments of the present disclosure provide designed metal and dielectric elements placed above the arbitrary radiator (i.e., in the superstrate region) to simultaneously aid impedance and polarization challenges. These elements can be referred to as superstrates and/or Superstrate Polarization and Impedance Rectifying Elements (SPIREs) and can be compatible with arbitrary antenna element types. In an embodiment, a SPIRE is a passive component that can be integrated modularly with arbitrary ESA antenna elements to synergistically rectify polarization and impedance challenges.

2. Dipole Arrays and Flared Notch Arrays

Conventional UWB-ESA elements include flared notch and dipole elements. The flared notch element is the most fielded array and inherently exhibits poor polarization. Dipole elements use superstate dielectric cover layers to improve impedance matching, but have yet to achieve the same bandwidth and impedance matching as flared notch elements.

Figure 1A:
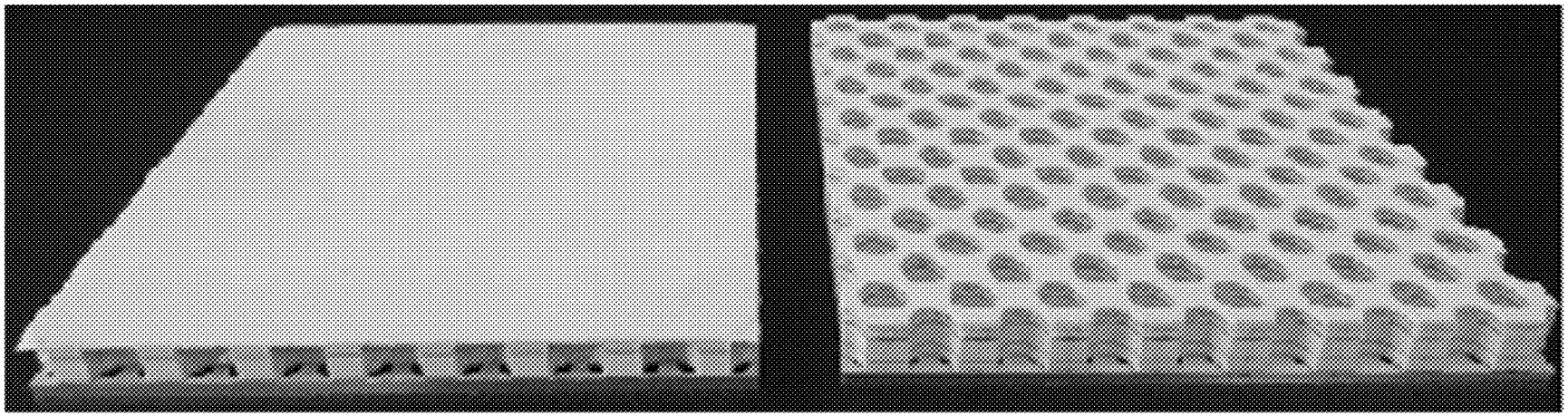
FIG. 1A PRIOR ART
FIG. 1A shows an exemplary Planar Ultrawideband Modular Antenna (PUMA) array.

FIG. 1A shows an exemplary Planar Ultrawideband Modular Antenna (PUMA) array. A PUMA array can be a simple, low-profile dipole array, with fully planar-printed manufacturing, UWB, and low cross-polarization. PUMA arrays are limited to 6:1 bandwidth and have poor impedance/matching when scanning. For example, PUMA arrays are typically electrically short, and this electrical shortness causes the PUMA array to have difficulty matching low frequency wavelengths (e.g., because longer wavelengths happen at lower frequencies).

Figure 1B:
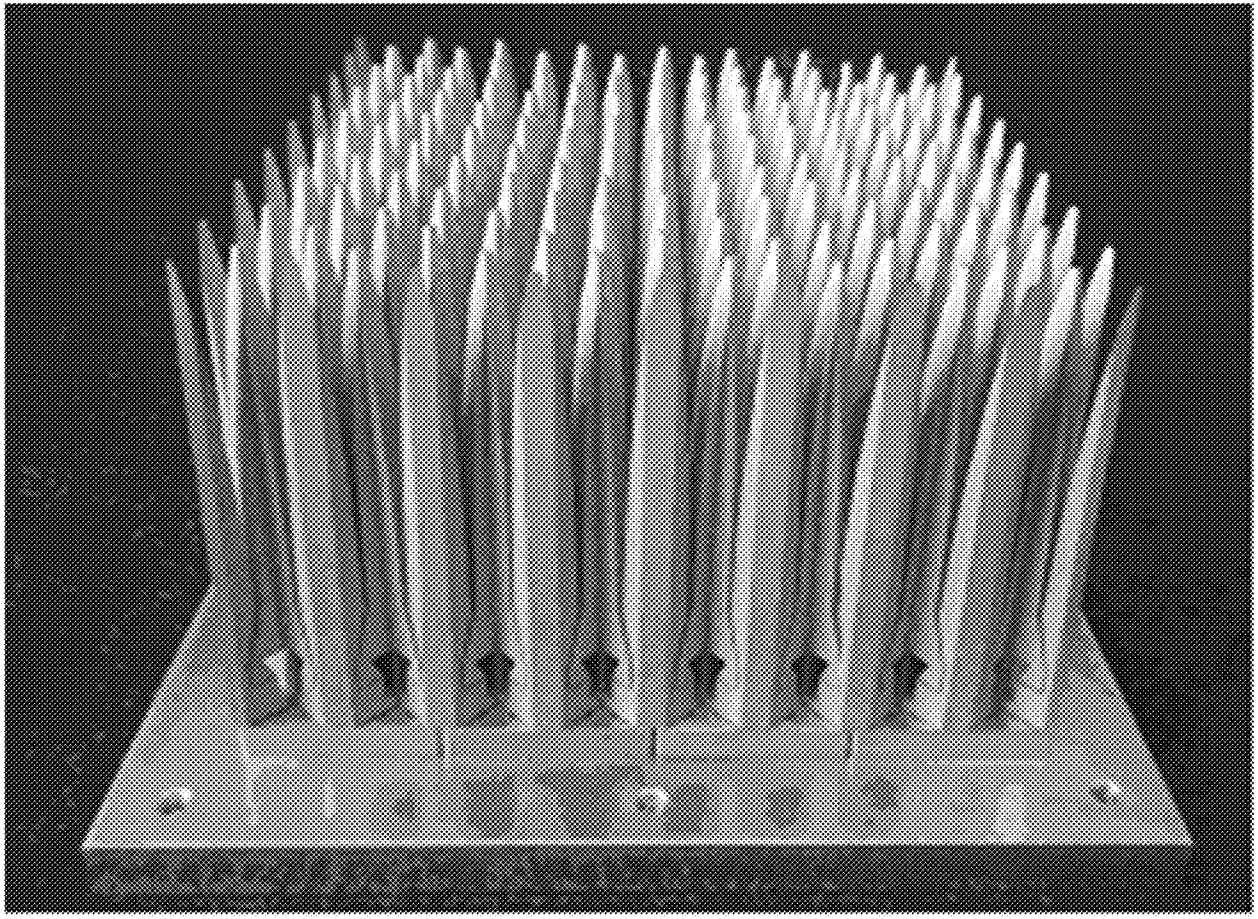
FIG. 1B PRIOR ART
FIG. 1B shows an exemplary flared notch array.

FIG. 1B shows an exemplary flared notch array. Flared notch arrays are, as of the filing date of this patent application, the most popular and fielded UWB array. Flared notch arrays, as of the filing date of this patent application, have some of the widest bandwidths achievable (e.g., >10:1) with excellent wide-scan matching. However, flared notch arrays have poor cross-polarization when scanning off the principal axes and are relatively thicker than PUMA-type arrays. For example, the longer contiguous profile of each element of the flared notch array leads the flared notch array to experience poor cross-polarization when scanning. Further, the conducting edges of the long tapered structures of the flared notch array elements causes large loop currents on the surface of the elements, which is advantageous for impedance matching but disadvantageous for cross-polarization.

3. Exemplary Arrays with Superstrates

Figure 1C:
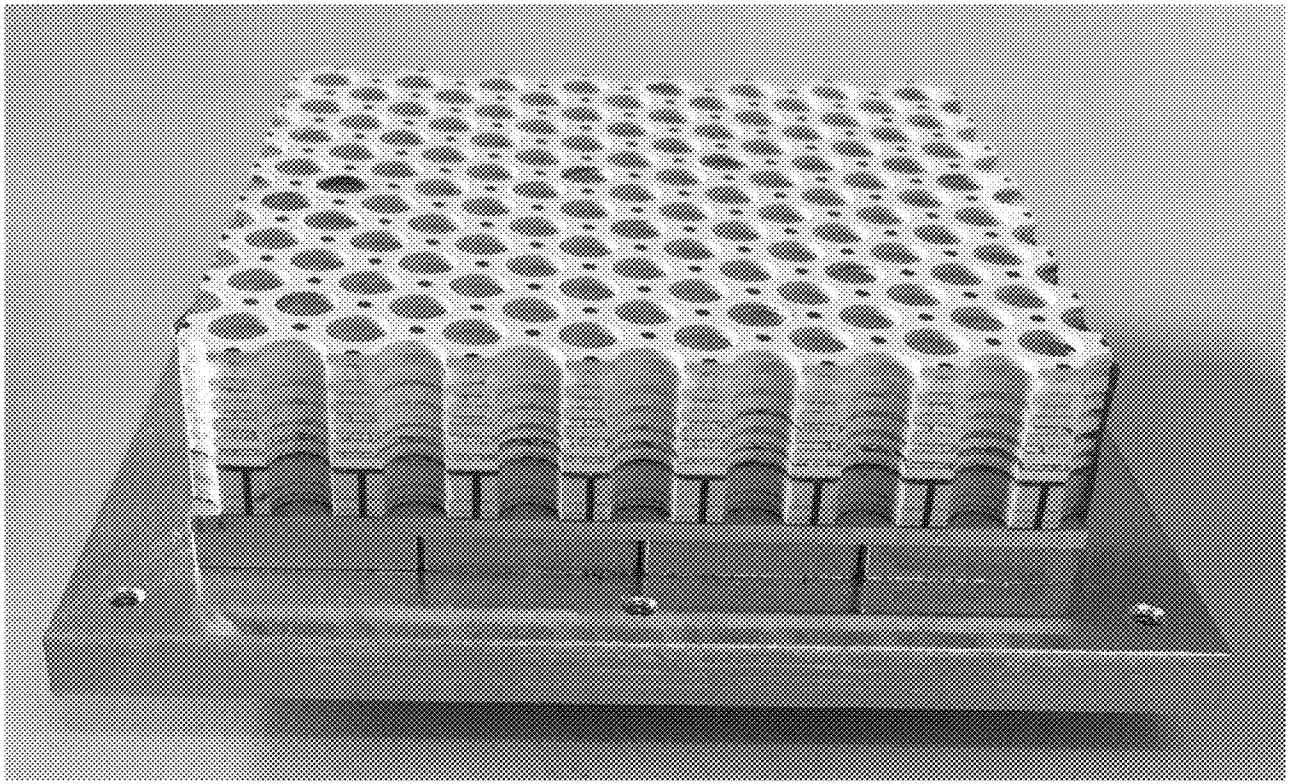
FIG. 1C shows an exemplary array in accordance with an embodiment of the present disclosure.
Figure 1D:
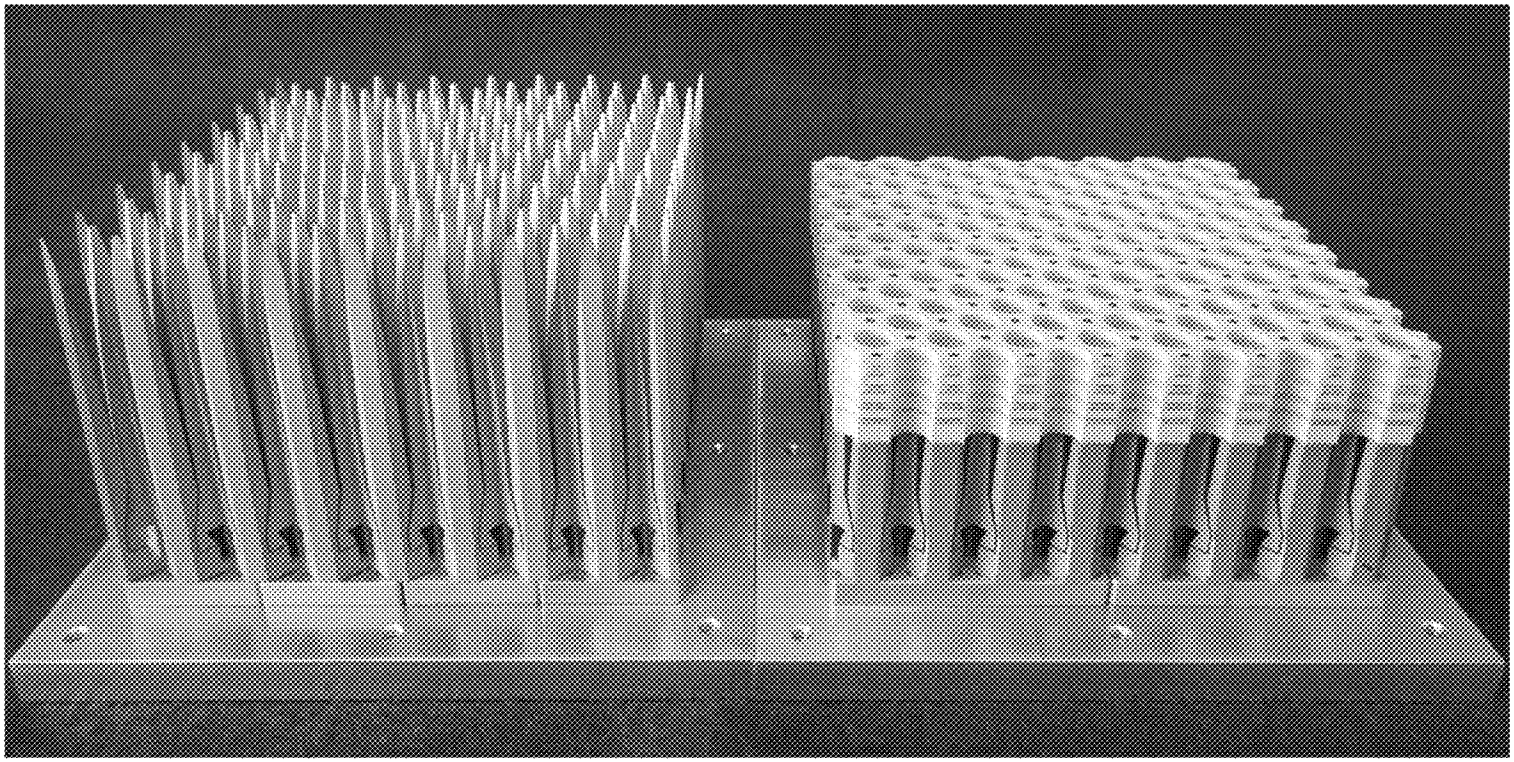
FIG. 1D shows a flared notch antenna (left) and an exemplary array in accordance with an embodiment of the present disclosure (right) having a notch antenna element on the bottom with Superstrate Polarization and Impedance Rectifying Elements (SPIREs) on top.

FIG. 1C shows an exemplary array in accordance with an embodiment of the present disclosure. Specifically, FIG. 1C shows a PUMA array used as an antenna base element with SPIREs loaded on top as a superstrate to improve impedance and polarization, enabling better radiation. FIG. 1D shows a flared notch antenna (left) and an exemplary array in accordance with an embodiment of the present disclosure (right). The array on the right has a flared notch antenna element used as an antenna base element with SPIREs loaded on top as a superstrate.

In an embodiment, a superstrate in accordance with an embodiment of the present disclosure loaded on top of a PUMA antenna base can improve the impedance-matching of the PUMA antenna base while maintaining or improving the cross-polarization of the PUMA antenna base. In an embodiment, a superstrate in accordance with an embodiment of the present disclosure loaded on top of a flared notch antenna base can improve the cross-polarization of the flared notch antenna base while maintaining or improving the impedance matching of the flared notch antenna base.

Embodiments of the present disclosure provide a simple solution to aid both polarization and impedance and provide a universal solution to improve impedance and polarization, regardless of the underlying original ESA radiator type. A structure in accordance with an embodiment of the present disclosure can be designed to integrate modularly with the base radiator, such that existing feeding manifolds need not be modified. Further, a structure in accordance with an embodiment of the present disclosure can retain the advantageous tapered profile (e.g., as in a flared notch array) that aids in impedance matching while avoiding the large loop currents caused by the contiguous structure of the flared notch array.

For example, embodiments of the present disclosure can provide a structure with a relatively tall profile (thus aiding low frequency impedance matching). Advantageously, in an embodiment, the profile of a structure is not contiguous, thus avoiding the cross-polarization complications caused by structures with a relatively tall contiguous profile. For example, embodiments of the present disclosure can achieve the desired tall profile with conductive posts and/or panels that are capacitively (e.g., rather than directly) coupled to each other.

Further, embodiments of the present disclosure can maintain the original propagating wave mode of the antenna base elements as the wave travels through the superstrate (e.g., SPIREs) on top of the antenna base elements. For example, a propagating wave mode can be an intended radiation mechanism for an antenna element. In an embodiment, as the antenna base element emanates the wave through the SPIRE, the SPIRE can favorably condition the radiating wave such that the wave can be configured to have desired impedance-matching and polarization characteristics.

Additionally, embodiments of the present disclosure can minimally degrade performance regardless of the scan direction. For example, electrically long contiguous flares such as those of flared notch arrays have degraded performance in inter-cardinal regions.

Embodiments of the present disclosure offer a generic solution to improve the UWB impedance and cross-polarization of an arbitrary antenna element radiator used as an antenna base element by integrating a superstrate (e.g., SPIRE) in accordance with an embodiment of the present disclosure. For example, a SPIRE in accordance with an embodiment of the present disclosure can be integrated into a flared notch array or a PUMA array to improve both the UWB impedance and cross-polarization of the array, thereby reducing the disadvantages of both PUMA and flared notch arrays. While superstrates in accordance with embodiments of the present disclosure are discussed herein as being integrated onto PUMA or flared notch antenna base elements, it should be understood that superstrates in accordance with embodiments of the present disclosure can also be integrated onto other antenna base elements as well.

Embodiments of the present disclosure enable existing UWB-ESAs of arbitrary radiator basis type to achieve a 10:1 bandwidth and low cross-polarization, i.e. state-of-the-art high-performance. Embodiments of the present disclosure have been validated through theoretical formulation, design simulation, and measurement to demonstrate the highest performing UWB-ESAs to date as of the filing date of this patent application.

4. Exemplary Antenna Base and Superstrate Components

In an embodiment, a superstrate (e.g., a SPIRE superstrate) in accordance with an embodiment of the present disclosure can be placed above the base structure of an existing radiator type (e.g., a dipole array, flared notch array, etc.) to improve performance. For example, in an embodiment, SPIREs can be coupled to an antenna element for improved radiation behavior, particularly in a linear or planar array.

Figure 2A:
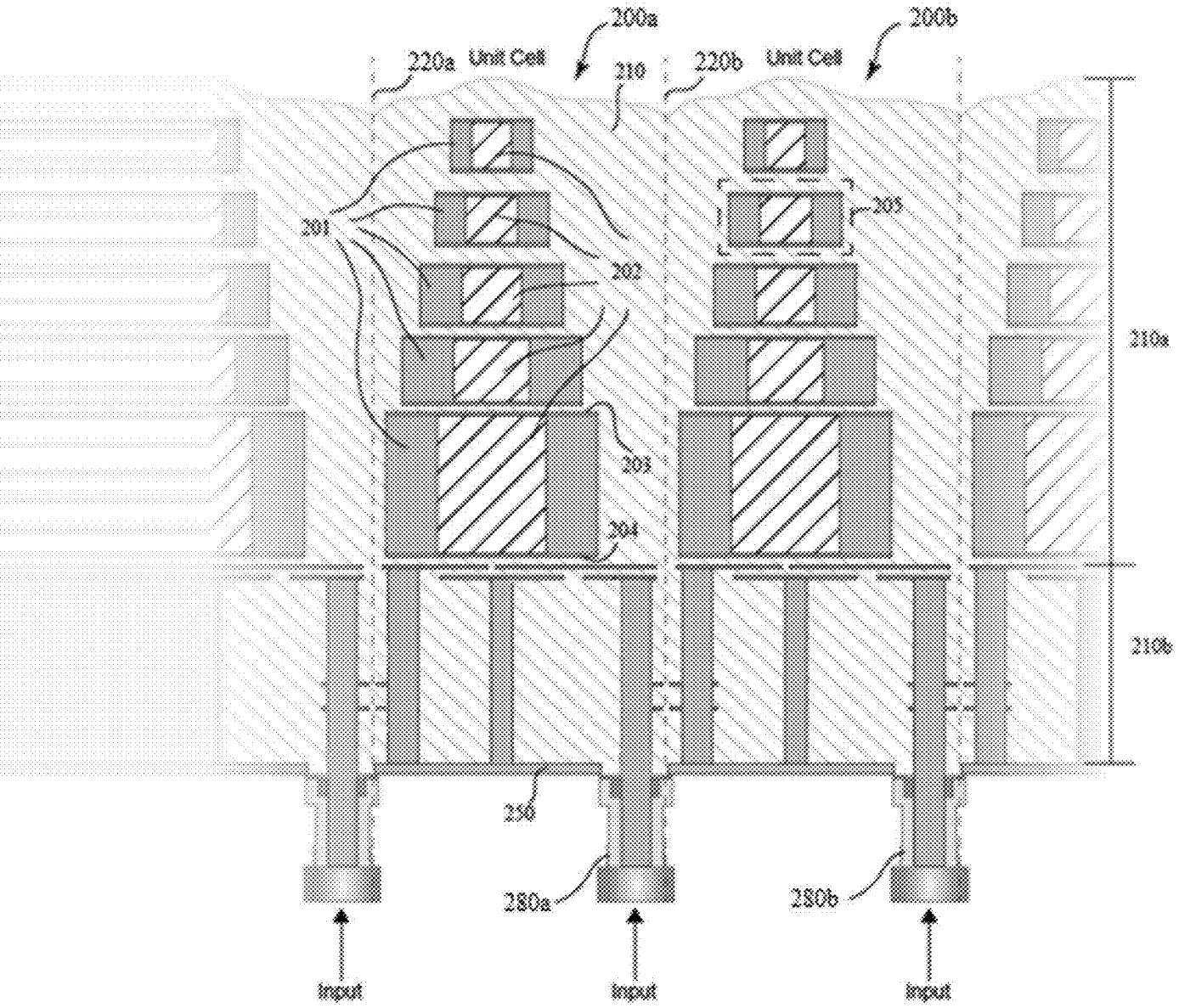
FIG. 2A is a diagram of an array structure including SPIREs in accordance with an embodiment of the present disclosure.

FIG. 2A is a diagram of an array structure including SPIREs in accordance with an embodiment of the present disclosure. The array of FIG. 2A includes a plurality of unit cells 200. In an embodiment, each unit cell includes a SPIRE 210*a* (also referred to as SPIRE component) mounted on top of an antenna base 210*b* (also referred to as antenna base element). In an embodiment, SPIREs 210*a* form an outward taper from the antenna base element 210*b* and can be hollow on the interior. In an embodiment, each antenna element formed by a SPIRE 210*a* and antenna base element 210*b* includes a radiating body (e.g., which can be shaped based on an application) which is conductively connected at its base to electrical and mechanical support structures, grounded by ground 250, that contain feeds, baluns, and/or matching networks with a signal path to a guided wave feed port 280.

In an embodiment, each SPIRE 210*a* includes a plurality of conductive panels 205. While only one conductive panel 205 is labeled in FIG. 2A for visual clarity, it should be understood that FIG. 2A has other conductive panels that are not labeled. For example, in FIG. 2A, each unit cell has five conductive panels shown. Further, while five conductive panels are shown in each unit cell of FIG. 2A, it should be understood that a SPIRE in accordance with an embodiment of the present disclosure can include any number of conductive panels.

In an embodiment, each conductive panel 205 includes conductive posts 201 (e.g., in an embodiment, plated vias on either side of the conductive panel 205) and an interior region 202. In an embodiment, conductive posts 201 are capacitively coupled to each other. In an embodiment, interior region 202 is hollow and filled with air. In an embodiment, interior region 202 is filled (e.g., with dielectric material). In an embodiment, each conductive panel 205 has a conductive plate 203 on top of the conductive panel 205 and a conductive plate 204 on the bottom of the conductive panel 205. In an embodiment, conductive posts 201 of each conductive panel 205 are in direct contact with conductive plates 204 and 205 of each conductive panel.

In an embodiment, each SPIRE 210*a* can form outward flared openings at one end, into a second end electrically coupled to an antenna base element 210*b* beneath, which can be coupled to a feed connection. Conductive panels 205 may be divided into a plurality of segments and shapes, forming a conductive perimeter that largely follows the outward taper envelope. A variety of amounts of SPIRES with arbitrary thicknesses is possible, each of which may be arbitrarily separated in space. The body of the SPIRE 210*a* of each unit cell 200 may take on a plurality of shapes and sizes to form a plurality of tapered slot regions. The SPIREs 210*a* and antenna base element 210*b* can form a plurality of elements that can be directed towards service in a one-dimensional or two-dimensional periodic array with a period D (or Dx and Dy for a two-dimensional case).

In an embodiment, conductive panels 205 do not need to be directly connected to electrical and support components due to strong capacitive coupling that effectively allows conductive current to flow at the frequencies of interest. Also, the gaps formed between conductive panels 205 (location, shape, width, length, etc.) can be configured to tune-out a gap resonance that could otherwise arise. In an embodiment, gap regions between conductive panels 205 can be filled with non-conductive or low-conductivity mediums 210 (e.g., in an embodiment, comprised of materials with low relative permittivity $1 \leq \varepsilon_r \leq 10$ such as air, PTFE dielectric, bonding ply, and/or foam). The number, location, size, and material composition of the gap regions can vary along the entirety of the bodies of SPIREs 210*a*.

Embodiments of the present disclosure can advantageously provide strong coupling between conductive panels 205. For example, in an embodiment, the spacing between conductive panels 205 is tight (e.g., in an embodiment, less than $\lambda/2$), and the surface area of conductive plates 203 and 204 at the top and bottom of each conductive panel 205 forms a polygonal shape (e.g., a circle, square, irregular polygon, etc.) that enhances conductivity across the entire surface of the conductive plates.

In an embodiment, conductive panels 205 support current loops. For example, flared notch arrays (e.g., as shown in FIG. 1B) support large current loops, which aid in low frequency wide-scan impedance matching. In an embodiment, each conductive panel 205 supports one or more smaller current loops that can also aid in low frequency wide-scan impedance matching. Together, a group of conductive panels 205 can accomplish the same or better impedance matching as an equivalent electrical sized flared notch array while also minimally degrading cross-polarization.

In an embodiment, the gap between conductive panels 205 can be maximized because larger gaps selectively constrain the current loops along the profile of the element such that the current loops remain sufficiently small to minimally degrade cross-polarization. However, in an embodiment, the gap between conductive panels 205 is not made so large as to degrade impedance-matching capabilities of the element. Thus, in an embodiment, gap(s) between conductive panels 205 can be configured (e.g., in an embodiment, based on desired characteristics for an antenna application) such that current loops remain sufficiently small and impedance-matching capabilities of the element are not degraded to an undesirable amount (e.g., a predetermined threshold amount).

Figure 2B:
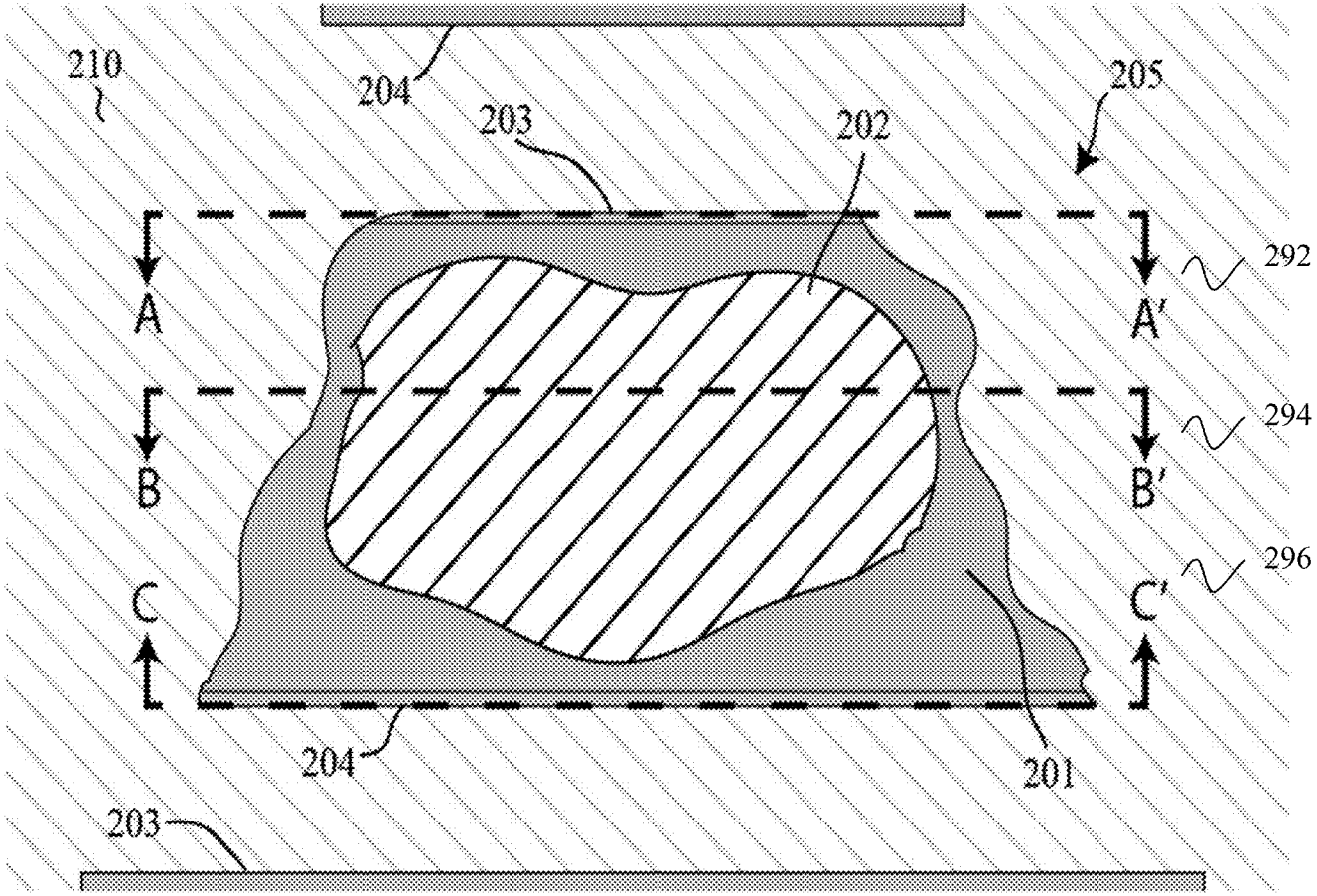
FIG. 2B is a diagram of a cross-section of an exemplary SPIRE component in accordance with an embodiment of the present disclosure.

FIG. 2B is a diagram of a cross-section of an exemplary SPIRE component 210*a* in accordance with an embodiment of the present disclosure. The SPIRE component 210*a* of FIG. 2B shows layers A-A' 292, B-B' 294, and C-C' 296.

Figure 2C:
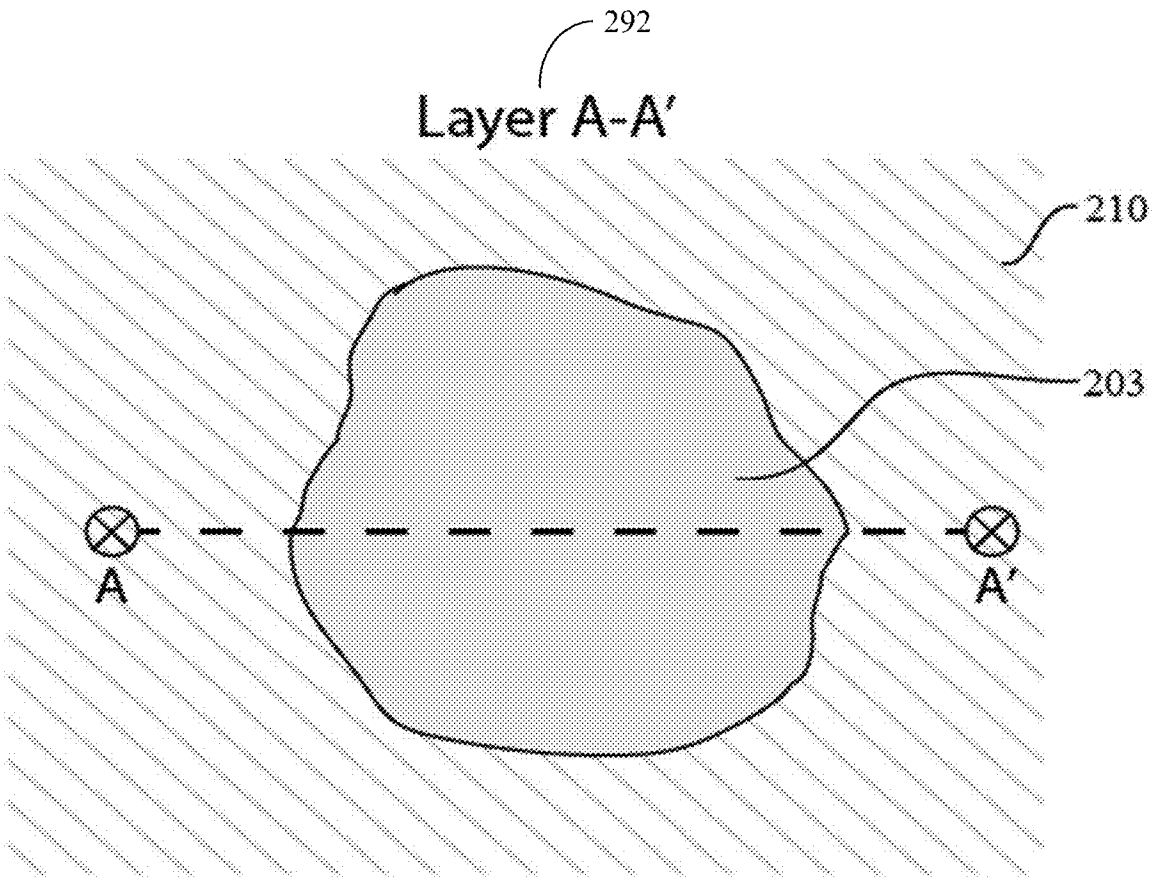
FIG. 2C is a diagram of layer A-A' of the SPIRE component of FIG. 2B in accordance with an embodiment of the present disclosure.

FIG. 2C is a diagram of layer A-A' 292 of the SPIRE component 210*a* of FIG. 2B in accordance with an embodiment of the present disclosure. Specifically, FIG. 2C shows a top view of layer A-A' of FIG. 2B. In an embodiment, layer C-C' 296 of FIG. 2B resembles FIG. 2C.

Figure 2D:
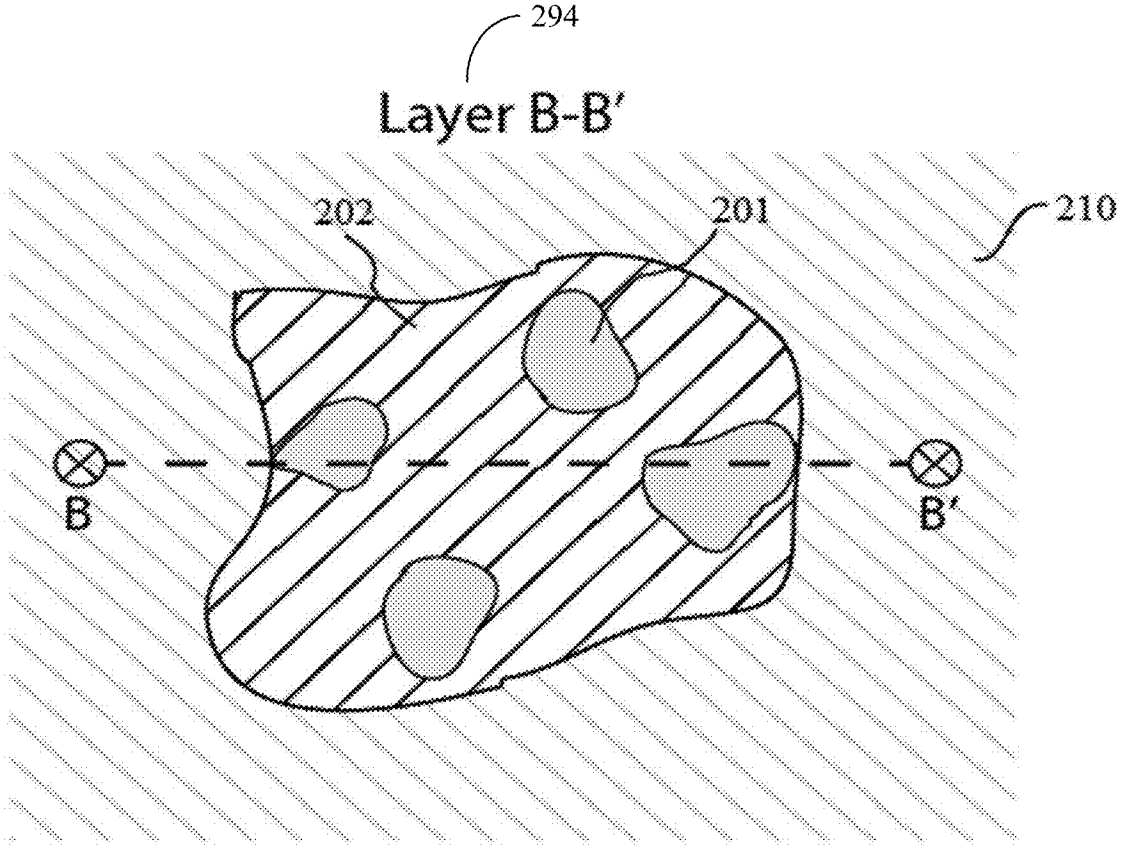
FIG. 2D is a diagram of layer B-B' of the SPIRE component of FIG. 2B in accordance with an embodiment of the present disclosure.

FIG. 2D is a diagram of layer B-B' 294 of the SPIRE component 210*a* of FIG. 2B in accordance with an embodiment of the present disclosure. Specifically, FIG. 2C shows a top view of layer B-B' of FIG. 2B. FIG. 2D shows four conductive posts 201. However, it should be understood that each conductive panel 205 can include a variety of numbers of conductive posts (e.g., depending on available space within each conductive panel 205) in accordance with embodiments of the present disclosure.

Figure 3:
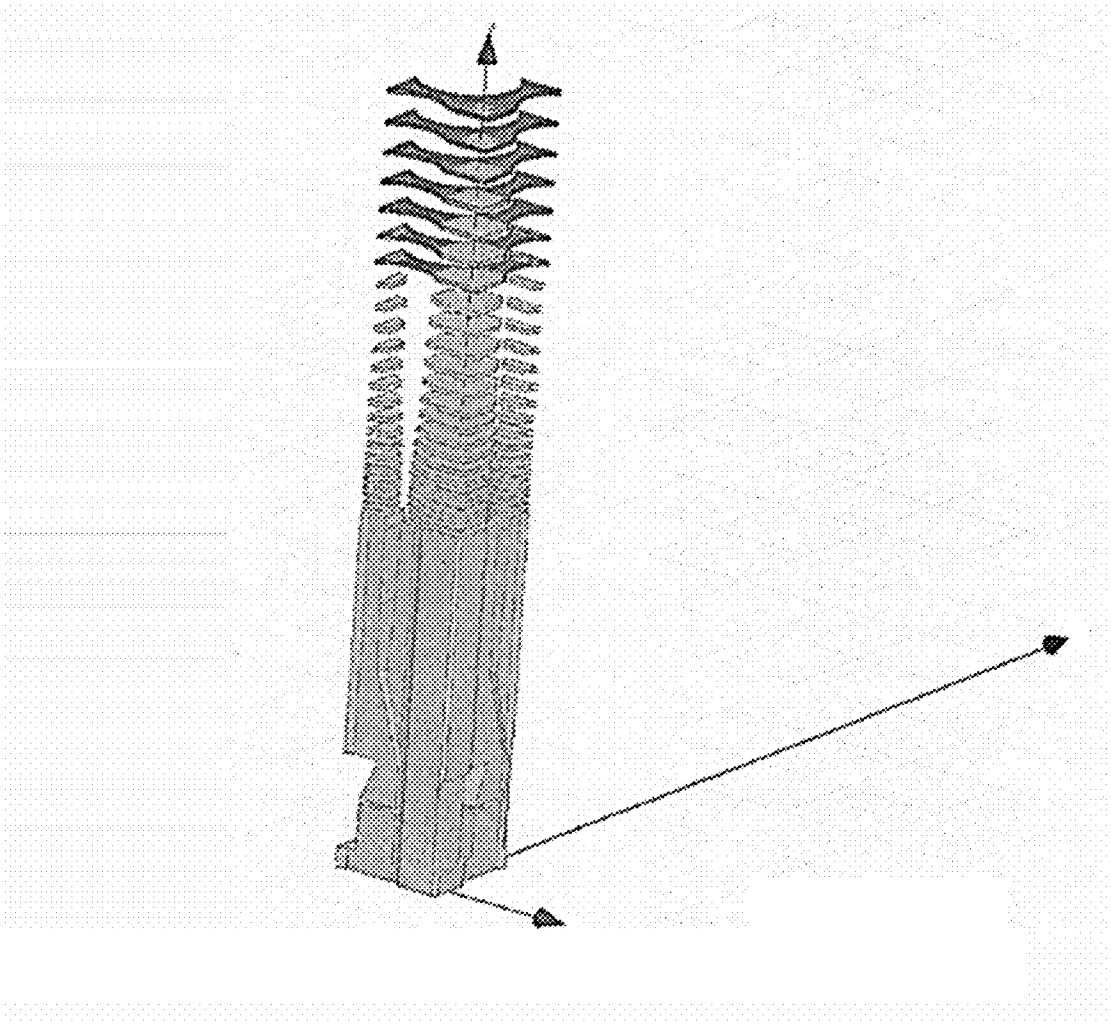
FIG. 3 shows a diagram with a vertical view of an exemplary embodiment of the present disclosure.
Figure 4:
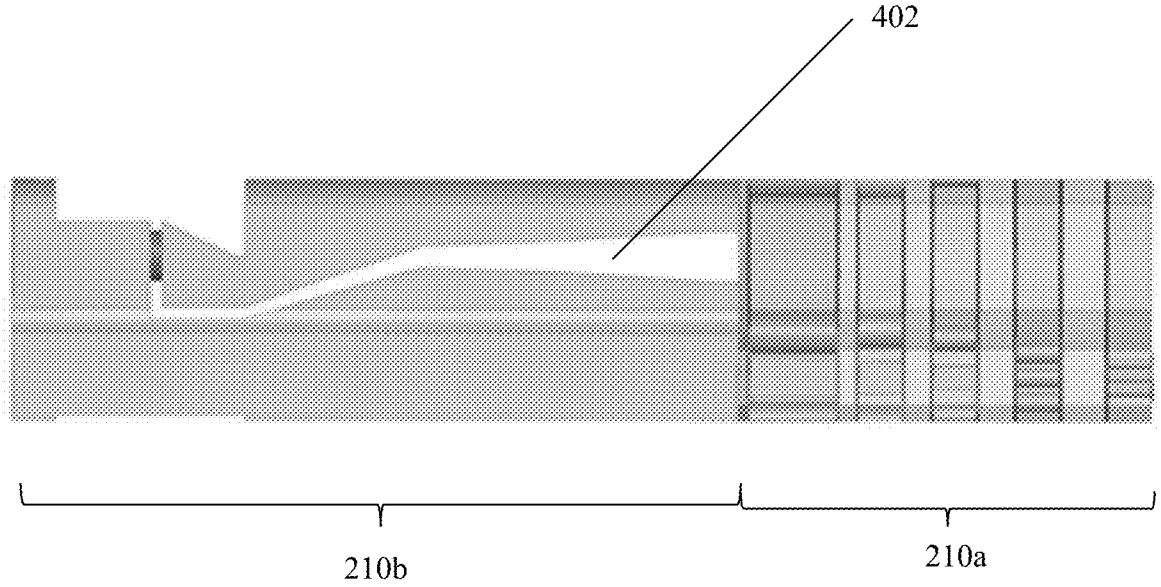
FIG. 4 shows a diagram with a horizontal view of an exemplary embodiment of the present disclosure.

FIG. 3 shows a diagram with a vertical view of an exemplary embodiment of the present disclosure. FIG. 3 illustrates a variety of spaces between each conductive panel 205. FIG. 4 shows a diagram with a horizontal view of an exemplary embodiment of the present disclosure. Specifically, FIG. 4 shows a diagram with a horizontal view of SPIRE component 210*a* and an antenna base 210*b* in accordance with an embodiment of the present disclosure. As shown in FIG. 4, in an embodiment, hollowed out metal 402 is present in the middle of the antenna base element 210*b* (e.g., as in a flared notch array). As discussed above, a variety of different antenna base components can be used to form antenna base element 210*b*.

Figure 5A:
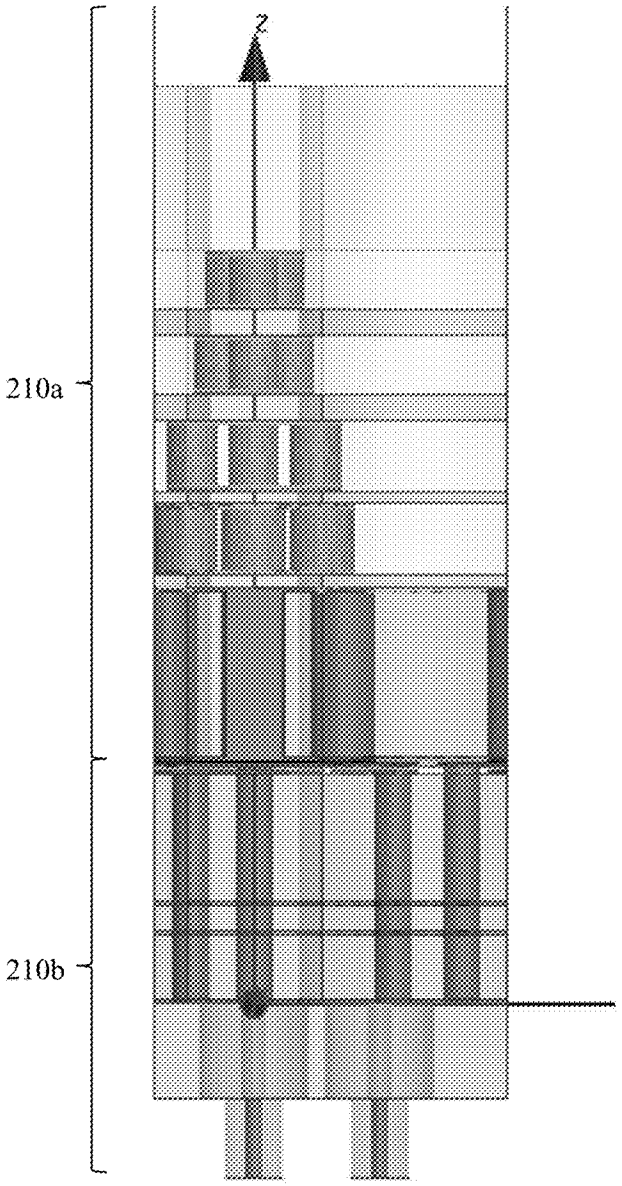
FIG. 5A is a two-dimensional diagram of a SPIRE component and an antenna base with conductive panels connected with conductive posts in accordance with an embodiment of the present disclosure.
Figure 5B:
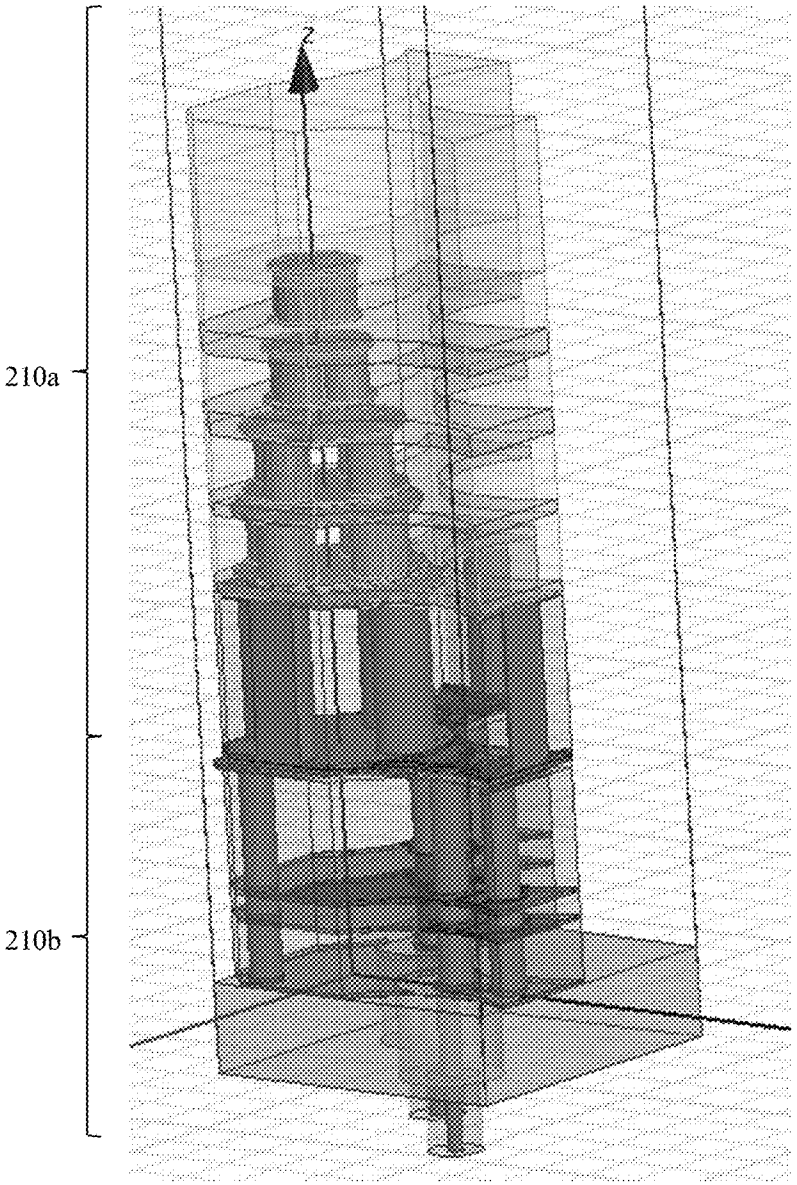
FIG. 5B is a three-dimensional diagram of a SPIRE component and an antenna base with conductive panels connected with conductive posts in accordance with an embodiment of the present disclosure.

FIG. 5A is a two-dimensional diagram of a SPIRE component 210*a* and an antenna base 210*b* with conductive panels connected with conductive posts in accordance with an embodiment of the present disclosure. FIG. 5B is a three-dimensional diagram of a SPIRE component 210*a* and an antenna base 210*b* with conductive panels connected with conductive posts in accordance with an embodiment of the present disclosure.

In an embodiment, conductive posts 201 can be removed. In an embodiment, flat conductive panels can be configured to be capacitively coupled to each other and can have a reduced thickness when compared to embodiments using conductive posts. FIG. 6A is a two-dimensional diagram of a SPIRE component 210*a* and an antenna base 210*b* without conductive posts (i.e., with flat conductive panels) in accordance with an embodiment of the present disclosure. In FIG. 6A, flat conductive panels are very small, giving the impression that each flat conductive panel is a flat structure. FIG. 6B is a three-dimensional diagram of a SPIRE component 210*a* and an antenna base 210*b* without conductive posts (i.e., with flat conductive panels) in accordance with an embodiment of the present disclosure. FIG. 7 is a three-dimensional diagram of a SPIRE component 210*a* and an antenna base 210*b* without conductive posts (i.e., with flat conductive panels), wherein the flat conductive panels are divided into four segments in accordance with an embodiment of the present disclosure. In an embodiment, the division of the flat conductive panels into four segments as shown in FIG. 7 is convenient for modular assembly.

5. Exemplary Advantages and Distinctions

Arrays with a superstrate (e.g., SPIREs) in accordance with embodiments of the present disclosure improve upon existing antenna elements to rectify degraded impedance and polarization performance, particularly when scanning away from broadside. Arrays with a superstrate in accordance with embodiments of the present disclosure can be tailored to different, common manufacturing methods. One may be more convenient than the other (e.g., hollowed metal structures can be easier for standard low-cost microwave printing procedures, while solid structures can be easier for stock-metal subtractive manufacturing procedures).

Embodiments of the present disclosure address longstanding performance issues in wideband antenna arrays for decades by including the SPIRE technology. The superstrates can be modularly assembled, which improves upon existing technologies that require electrical connection between adjacent elements, making it difficult to assemble, repair, and maintain.

Embodiments of the present disclosure have advantages over conventional radomes. For example, SPIREs can be made in such a way as not to disturb, as best as possible, the intrinsic operation of the underlying array or antenna. Embodiments of the present disclosure have advantages over Wide Angle Impedance Matching (WAIM). A WAIM is designed to remove surface waves and periodic bandgap resonances or guided waves in the underlying array or antenna. Embodiments of the present disclosure, for example, can work just as well for things that don't have any of these to begin with. WAIMs don't use conductive materials in the superstrate. Embodiments of the present disclosure have advantages over Frequency Selective Surfaces (FSSs) because they can be intrinsically frequency independent. Embodiments of the present disclosure have advantages over folded notch arrays since it uses shifting/alternating plates, disturbs the traveling wave structure, does not help polarization, and doesn't couple the signal in the same way. Embodiments of the present disclosure have advantages over Artificial Dielectric Layers (ADLs). ADLs use small periodic metallic structures (i.e., patches on transverse layers across the entire element structure). There is no taper. SPIREs in accordance with embodiments of the present disclosure can form a taper and can be placed in a specific region (e.g., not just across the entire element).

Arrays with SPIREs in accordance with embodiments of the present disclosure represent the best PUMA and notch performance to date (e.g., with enhanced bandwidth and improved impedance/polarization), as of the filing date of this patent application. Arrays with SPIREs in accordance with embodiments of the present disclosure represent the first time exceptional UWB polarization control and wide-scan impedance was achieved via adding a specialized superstrate (i.e. SPIRE). When compared with conventional arrays, arrays with SPIREs in accordance with embodiments of the present disclosure can achieve higher communication data rates, have more system functionality integration with a single array, have higher radar resolution, have better tracking of low-elevation observables, have higher sensitivity for improved imaging (e.g., radio astronomy), are more robust against jamming and electronic countermeasures, and have increased electronic attack capabilities. In an embodiment, arrays with SPIREs in accordance with embodiments of the present disclosure can achieve all of the above while remaining backwards-compatible with existing UWB systems, thus requiring little system downtime for replacement. Arrays with SPIREs in accordance with embodiments of the present disclosure further provide improved logistics support and warfighter capabilities.

6. Conclusion

It is to be appreciated that the Detailed Description, and not the Abstract, is intended to be used to interpret the claims. The Abstract may set forth one or more but not all exemplary embodiments of the present disclosure as contemplated by the inventor(s), and thus, is not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Any representative signal processing functions described herein can be implemented using computer processors, computer logic, application specific integrated circuits (ASIC), digital signal processors, etc., as will be understood by those skilled in the art based on the discussion given herein. Accordingly, any processor that performs the signal processing functions described herein is within the scope and spirit of the present disclosure.

The above systems and methods may be implemented as a computer program executing on a machine, as a computer program product, or as a tangible and/or non-transitory computer-readable medium having stored instructions. For example, the functions described herein could be embodied by computer program instructions that are executed by a computer processor or any one of the hardware devices listed above. The computer program instructions cause the processor to perform the signal processing functions described herein. The computer program instructions (e.g., software) can be stored in a tangible non-transitory computer usable medium, computer program medium, or any storage medium that can be accessed by a computer or processor. Such media include a memory device such as a RAM or ROM, or other type of computer storage medium such as a computer disk or CD ROM. Accordingly, any tangible non-transitory computer storage medium having computer program code that cause a processor to perform the signal processing functions described herein are within the scope and spirit of the present disclosure.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments.

What is claimed is:

1. An array element, comprising:

an antenna base element configured to propagate a wave according to a propagating wave mode; and a superstrate mounted on top of the antenna base, wherein the superstrate comprises a plurality of capacitively-connected conductive panels, and wherein the superstrate is configured to maintain the wave according to the propagating wave mode within the superstrate, and wherein each capacitively-connected conductive panel comprises:

a conductive post;

a first conductive plate coupled to a top surface of the conductive post; and a second conductive plate coupled to a bottom surface of the conductive post.

2. The array element of claim 1, wherein the propagating wave mode has a desired polarization property, and wherein the superstrate is configured to maintain the wave according to the propagating wave mode within the superstrate without changing the desired polarization property.

3. The array element of claim 1, wherein the superstrate is configured to maintain the wave according to the propagating wave mode within the superstrate without depolarizing the wave.

4. The array element of claim 1, wherein the sizes of gaps between each capacitively-connected conductive panel are selected such that current loops within each capacitively-connected conductive panel remain sufficiently small and impedance-matching capabilities of the array element are not degraded below a predetermined threshold.

5. The array element of claim 1, wherein the superstrate forms an outward taper from the antenna base element, and wherein the conductive panels form a conductive perimeter that follows the outward taper.

6. The array element of claim 1, wherein the antenna base element is a dipole antenna base element.

7. The array element of claim 1, wherein the antenna base element is a flared notch antenna base element.

8. The array element of claim 1, wherein the antenna base element is a Planar Ultrawideband Modular Antenna (PUMA) antenna base element.

9. The array element of claim 1, wherein each capacitively-connected conductive panel is configured to support a current loop.

10. The array element of claim 9, wherein a plurality of capacitively-connected conductive panels are configured to accomplish, based on current loops within each capacitively-connected conductive panel, the same or similar impedance matching as an equivalent electrical sized flared notch array while also minimally degrading cross-polarization while the array element is scanning.

11. The array element of claim 9, wherein the sizes of gaps between each capacitively-connected conductive panel are selected such that current loops within each capacitively-connected conductive panel remain sufficiently small to minimally degrade cross-polarization while the array element is scanning.

12. The array element of claim 9, wherein the sizes of gaps between each capacitively-connected conductive panel are selected such that the gaps are not made so large as to degrade impedance-matching capabilities of the array element.

13. An antenna array, comprising:

a plurality of unit cells, wherein each unit cell in the plurality of unit cells comprises:

an antenna base element configured to propagate a wave according to a propagating wave mode, and a superstrate mounted on top of the antenna base, wherein the superstrate comprises a plurality of capacitively-connected conductive panels, and wherein the superstrate is configured to maintain the wave according to the propagating wave mode within the superstrate, and wherein each capacitively-connected conductive panel comprises:

a conductive post;

a first conductive plate coupled to a top surface of the conductive post; and a second conductive plate coupled to a bottom surface of the conductive post.

14. An antenna array element, comprising:

an antenna base element configured to propagate a wave according to a propagating wave mode; and a superstrate mounted on top of the antenna base, wherein the superstrate comprises:

a first conductive panel, and a second conductive panel capacitively coupled to the first conductive panel, wherein the superstrate is configured to maintain the propagating wave mode within the superstrate, and wherein the first conductive panel comprises:

a conductive post a first conductive plate coupled to a top surface of the conductive post:

and a second conductive plate coupled to a bottom surface of the conductive post.

15. The antenna array element of claim 14, wherein the first conductive panel is configured to support a first current loop, and wherein the second conductive panel is configured to support a second current loop.

16. The antenna array element of claim 14, wherein the propagating wave mode has a desired polarization property, and wherein the superstrate is configured to maintain the wave according to the propagating wave mode within the superstrate without changing the desired polarization property.

17. The antenna array element of claim 14, wherein a size of a gap between the first conductive panel and the second conductive panel is selected such that current loops within the first conductive panel and the second conductive panel remain sufficiently small and impedance-matching capabilities of the superstrate are not degraded below a predetermined threshold.

18. The antenna array element of claim 14, wherein the superstrate forms an outward taper, and wherein shapes of the first conductive panel and the second conductive panel follow the outward taper.

* * * * *